US006228142B1

(12) United States Patent
Shin et al.

(10) Patent No.: US 6,228,142 B1
(45) Date of Patent: May 8, 2001

(54) APPARATUS FOR KEEPING OPTIMAL PENETRATION DEPTH FORMED AT FRONT END OF OXYGEN TUYERE AND METHOD FOR KEEPING THE SAME

(75) Inventors: Myoung Kyun Shin, Pohang; Yoon Chul Park, Seoul, both of (KR)

(73) Assignees: Pohang Iron & Steel Co., Ltd.; Research Institute of Industrial Science & Technology, both of (KR); Voest-Alpine Industrieanlagenbau GmbH (AU)

( * ) Notice: Subject to any disclaimer, the term of this patent is extended or adjusted under 35 U.S.C. 154(b) by 0 days.

(21) Appl. No.: 09/125,599

(22) PCT Filed: Dec. 19, 1997

(86) PCT No.: PCT/KR97/00273

§ 371 Date: Aug. 20, 1998

§ 102(e) Date: Aug. 20, 1998

(87) PCT Pub. No.: WO98/28447

PCT Pub. Date: Jul. 2, 1998

(30) Foreign Application Priority Data

Dec. 23, 1996 (KR) ..... 96-70113

(51) Int. Cl.[7] ..... C21C 5/30; C21C 5/48

(52) U.S. Cl. ..... 75/375; 75/379; 75/445; 75/550; 75/556; 266/86; 266/92; 266/223

(58) Field of Search ..... 75/375, 379, 445, 75/550, 556; 266/86, 92, 223

(56) References Cited

U.S. PATENT DOCUMENTS

| | | | | |
|---|---|---|---|---|
| 361,624 | * | 4/1887 | Gordon | 266/223 |
| 3,551,140 | * | 10/1967 | Nilles et al. | 75/379 |
| 3,720,404 | * | 3/1973 | Carlson et al. | 266/86 |
| 4,042,378 | * | 8/1977 | Ramelot | 75/375 |
| 4,530,102 | * | 7/1985 | Baker et al. | 266/86 |
| 4,978,387 | | 12/1990 | Kepplinger | 75/445 |
| 5,584,910 | * | 12/1996 | Kepplinger et al. | 75/445 |

FOREIGN PATENT DOCUMENTS

| | | |
|---|---|---|
| 6-145733 | 5/1994 | (JP) . |
| 8907156 | 8/1989 | (WO) . |
| 9208088 | 5/1992 | (WO) . |

OTHER PUBLICATIONS

American Hertigage Dictionary of the English Language, Third Edition, 1992 Houghton Mifflin Company.*

* cited by examiner

*Primary Examiner*—Roy V. King
*Assistant Examiner*—Tima McGuthry-Banks
(74) *Attorney, Agent, or Firm*—Webb Ziesenheim Logsdon Orkin & Hanson, P.C.

(57) ABSTRACT

An apparatus for keeping an optimal penetration depth formed at the front end of an oxygen tuyere in the producing facilities of molten pig iron utilizing non-coking coal and a method for keeping the same. A sensor for measuring distance using a laser for continuously measuring the penetration depth, is provided. Comprised is a process computer for continuously receiving the measured penetration depth from the sensor and comparing the received penetration depth with a predetermined optimal penetration depth to obtain a difference between them, and for obtaining a changing amount of a pressure in a melter gasifier through a mutual relation between a predetermined changing amount of a pressure in the melter gasifier with that of the penetration depth using the difference between the actual penetration depth with the optimal penetration depth. A scrubber cone controlling device for receiving the changing amount of the pressure in the melter gasifier from the process computer for changing an opening degree of a scrubber cone to change the pressure in the melter gasifier, is included. The apparatus and the method can actively cope with the change of the volumetric flow rate of the oxygen and the change of the constituting material in a coal packed bed, and can actively control an applied pressure in the melter gasifier to control the blowing velocity of the oxygen. The penetration depth can be optimally kept.

6 Claims, 3 Drawing Sheets

APPARATUS FOR KEEPING OPTIMAL PENETRATION DEPTH FORMED AT FRONT END OF OXYGEN TUYERE AND METHOD FOR KEEPING THE SAME

This application is a national stage of PCT/KR97/00273, filed Dec. 19, 1997.

BACKGROUND OF THE INVENTION

1. Field of the Invention

The present invention relates to an apparatus for keeping an optimal penetration depth formed at the front end of an oxygen tuyere and a method for keeping the same when producing molten pig iron utilizing non-coking coal, and more particularly to an apparatus for keeping an optimal penetration depth formed at the front end of an oxygen tuyere and a method for keeping the same using a sensor for measuring distance which is installed at the inside of oxygen tuyere when producing molten pig iron utilizing non-coking coal.

2. Description of the Prior Art

Generally, a blast furnace method, which forms the majority of the producing facilities of molten pig iron, requires raw material having a strength above a certain degree because of the characteristic of a reactor. As a carbon source used as a fuel and a reducing agent, coke obtained by processing a coking coal, is used. Accordingly, the producing facilities of the coke should be necessarily accompanied. In addition, the exhaustion of the raw coal of the coke and the regulation of various environment contaminating materials generated during the production of the coke has rapidly decreased the competitive power of the blast furnace method.

To cope with the above-mentioned circumstance, world nations have accelerate the development of production method of molten pig iron, which utilize the non-coking coal as the fuel and the reducing agent. U.S. Pat. No. 4,978,387 discloses the conventional production facilities of the molten pig iron using the non-coking coal.

According to U.S. Pat. No. 4,978,387, energy required for various processes is supplied through the combustion of a coal bed while injecting oxygen through a plurality of tuyeres, formed at the outer wall of the compacting layer with a constant distance in a circular shape, into the inner lower portion of the coal packed bed formed at a melter gasifier with a predetermined height. At this time, since the volumetric flow rate and the pressure of the oxygen injected through the tuyere are quite large and intensive, a space formed toward the inner portion of the coal packed bed (i.e. a penetration depth) is inevitably formed in front of the tuyere. The penetration depth largely affects the utilizing efficiency of the combustion energy, which is the supply source of the required energy in the production facilities of the molten pig iron utilizing the noncoking coal. Therefore, too short or too long penetration depth forms the gas as an excessive circumferential flow or an excessive central flow in the coal packed bed to deteriorate the effective use of the combustion energy.

Accordingly, an optimal keeping of the penetration depth is very important in the operation of the production facilities of the molten pig iron utilizing the non-coking coal. The optimal penetration depth is kept by keeping the oxygen blowing velocity at the tuyere constant by controlling the pressure applied in the melter gasifier according to the volume of the oxygen blown through the tuyere, for the present.

However, the penetration depth formed in the coal packed bed is under the influence of the structure, the particle size and the density of the coal which forms the coal packed bed, as well as the oxygen blowing velocity at the tuyere. Hence, even though the oxygen blowing velocity is kept constant, the optimal keeping of the penetration depth according to the change of various conditions of the raw material, is difficult.

SUMMARY OF THE INVENTION

Accordingly, it is an object of the present invention to improve the problems contained in the conventional method and to provide an apparatus for optimally keeping the penetration depth formed at the front end of the oxygen tuyere and a method for optimally keeping the same, which can actively cope with the change on the injection amount of the oxygen and the change on the constituting material in the coal packed bed according to the change of various conditions of the raw material and the operation.

To accomplish the object, there is provided in the present invention an apparatus for keeping an optimal penetration depth formed at a front end of an oxygen tuyere including a melter-gasifier for producing molten pig iron, a plurality of oxygen tuyeres formed around the outer lower portion of the melter gasifier for blowing oxygen into the melter gasifier, a cyclone for receiving an exhausted gas from the melter gasifier and for separating powder from the exhausted gas, a pre-reducing furnace for receiving the exhausted gas passed through the cyclone and for pre-reducing iron ores and a scrubber having a cone for controlling pressure in the melter gasifier, the apparatus comprising:

a sensor for measuring distance using a laser installed at an optional one of the oxygen tuyeres for continuously measuring the penetration depth;

a process computer for continuously receiving the measured penetration depth from the sensor for measuring distance using a laser and comparing the received penetration depth with a predetermined optimal penetration depth to obtain a difference between the actual penetration depth with the optimal penetration depth, and for obtaining a changing amount of pressure in the melter gasifier through a mutual relation between a predetermined changing amount of pressure in the melter gasifier with a changing amount of the penetration depth using the difference between the actual penetration depth and the optimal penetration depth; and a scrubber cone controlling device for receiving the changing amount of the pressure in the melter gasifier from the process computer and for changing an opening degree of a scrubber cone to change the pressure in the melter gasifier.

Another object of the present invention can be accomplished by a method for keeping an optimal penetration depth formed at a front end of an oxygen tuyere in a method for producing molten pig iron utilizing a producing apparatus of the molten pig iron utilizing non-coking coal, the apparatus including a melter gasifier for producing molten pig iron, a plurality of oxygen tuyeres formed around the outer lower portion of the melter gasifier for blowing oxygen into the melter gasifier, a cyclone for receiving an exhausted gas from the melter gasifier and for separating powder from the exhausted gas, a pre-reducing furnace for receiving the exhausted gas passed through the cyclone and for pre-reducing iron ores and a scrubber having a cone for controlling pressure in the melter gasifier, the method comprising the steps of:

establishing the optimal penetration depth according to a pressure in the melter gasifier under a constant amount of oxygen blowing;

obtaining a mutual relation between a changing amount of a pressure in the melter gasifier under a constant amount of oxygen blowing and a changing amount of the penetration depth;

continuously measuring the penetration depth by a sensor for measuring distance using a laser installed at optional one of the oxygen tuyeres;

continuously obtaining a difference between the measured actual penetration depth and the optimal penetration depth;

obtaining a changing amount of the pressure in the melter gasifier by the mutual relation between the changing amount of the pressure in the melter gasifier and the changing amount of the penetration depth utilizing the difference between the measured actual penetration depth and the optimal penetration depth;

controlling the pressure in the melter gasifier as much as the changing amount of the obtained pressure by controlling an opening degree of the scrubber cone; and repeating the steps until the actual penetration depth and the optimal penetration depth become the same.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Hereinafter, the preferred embodiment of the present invention will be explained in more detail with reference to the accompanying drawings.

Figure 1:
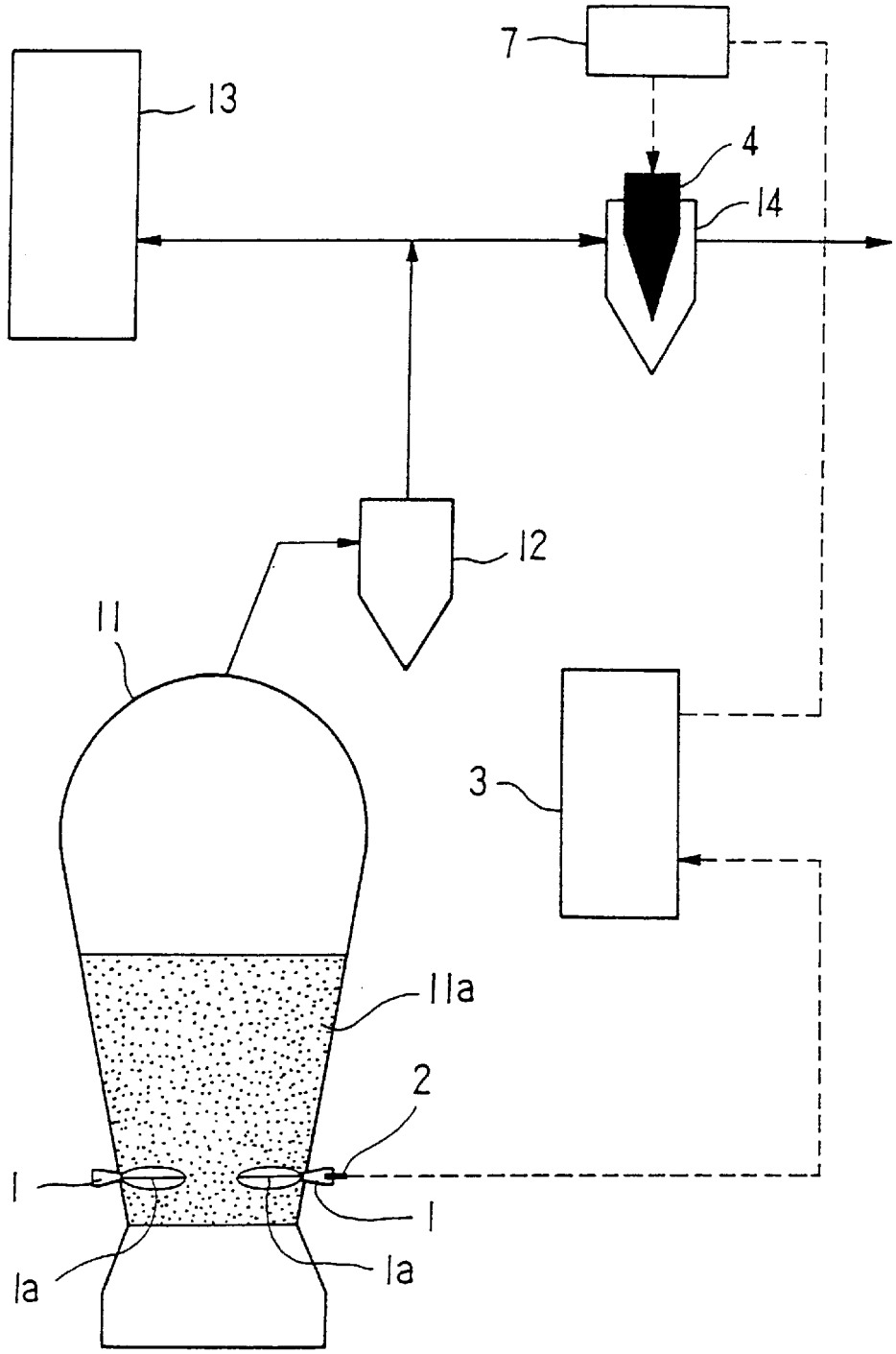
FIG. 1 is a constituting diagram of an apparatus for keeping an optimal penetration depth formed at the front end of an oxygen tuyere, which is provided in the producing facilities of molten pig iron utilizing noncoking coal, according to the present invention.

As illustrated in FIG. 1, the producing apparatus of the molten pig iron utilizing the non-coking coal includes a melter gasifier 11 for manufacturing the molten pig iron, a plurality of oxygen tuyeres 1 formed around the outer lower wall of melter gasifier 11 for blowing oxygen into melter gasifier 11, a cyclone 12 for receiving exhausted gas from melter gasifier 11 and separating powder from the exhausted gas, a pre-reducing furnace 13 for receiving the exhausted gas passed through cyclone 12 and for pre-reducing iron ores and a scrubber 14 having a cone 4 for controlling the pressure in melter gasifier 11.

The apparatus for keeping the optimal penetration depth formed at the front end of the oxygen tuyere according to the present invention, is installed at one optional oxygen tuyere of the producing apparatus of the molten pig iron using the non-coking coal. The apparatus includes a sensor for measuring distance using a laser 2 for continuously measuring a penetration depth la of the oxygen tuyere, a process computer 3 for obtaining the changing amount of an opening degree of the scrubber cone 4 and a scrubber cone controlling device 7 for changing the opening degree of scrubber cone 4.

Oxygen tuyeres 1 are formed at the lower and outer wall of a coal packed bed 11*a* in melter gasifier 11 with a predetermined distance in a plurality of circular shapes. At the center portion of one optional oxygen tuyere, sensor for measuring distance using a laser 2 for measuring the penetration depth of the oxygen tuyere, is installed.

Figure 2:
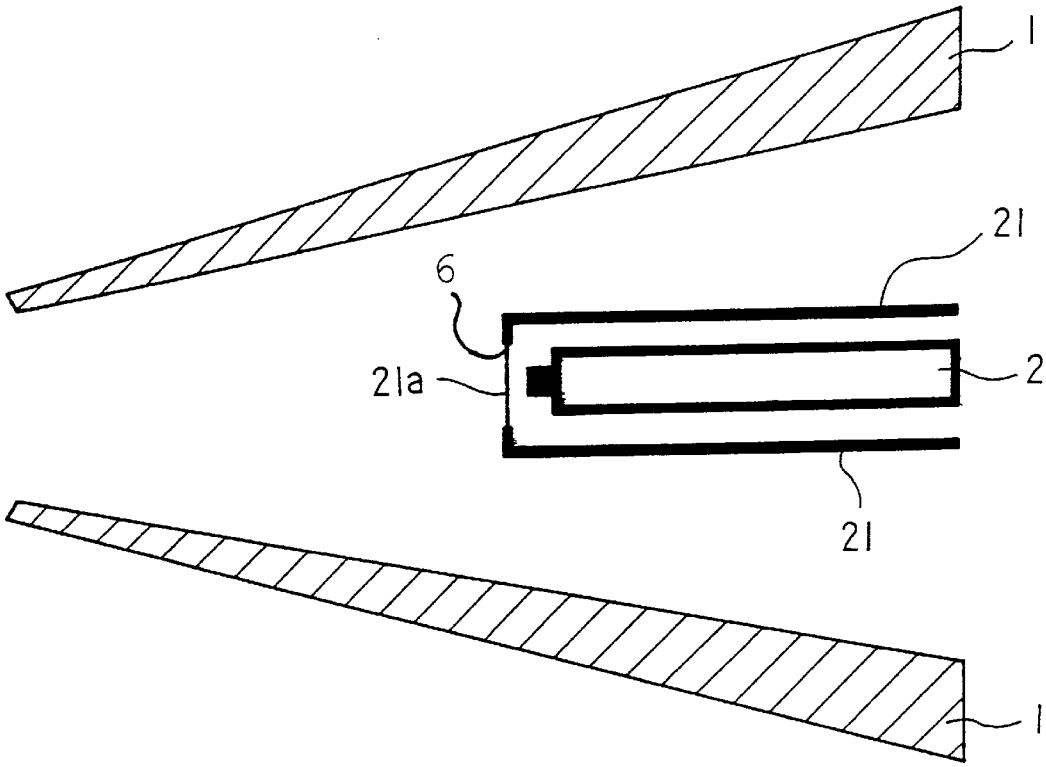
FIG. 2 is a detailed diagram of a sensor for measuring distance using a laser installed at the oxygen tuyere in the apparatus for keeping the optimal penetration depth according to the present invention.

At the outer portion of sensor for measuring distance using laser 2, a high tension steel casing 21 is preferably installed to prevent a malfunction and a breakage due to the applied pressure in oxygen tuyere 2, as illustrated in FIG. 2.

At the front end of high tension steel casing 21, a definite crevice 6 is formed for transmitting the laser generated from sensor for measuring distance using laser 2, and a fused silica having a plate shape 21*a* and a predetermined thickness is inserted into the crevice.

Meanwhile, process computer 3 is connected with sensor for measuring distance using a laser 2, as illustrated in FIG. 1, for continuously receiving the measured actual penetration depth from sensor for measuring distance using laser 2 and comparing the actual penetration depth with a predetermined optimal penetration depth to obtain a difference between the actual penetration depth and the optimal penetration depth. Process computer 3 obtains the changing amount of the pressure in the melter gasifier by a mutual relation between the predetermined changing amount of the pressure and the changing amount of the penetration depth in the melter gasifier utilizing the difference.

Scrubber cone controlling device 7 is connected with process computer 3 and controls the pressure in melter gasifier 11 by changing the opening degree of the scrubber cone by the changing amount of the pressure in melter gasifier 11 obtained by process computer 4.

The blowing velocity of the oxygen through oxygen tuyere 1 can be controlled through the controlling of the pressure in melter gasifier 11 by changing the opening degree of scrubber cone 4 by means of scrubber cone controlling device 7. As the result, penetration depth la can be optimally kept.

The method for keeping the optimal penetration depth formed at the front end of the oxygen tuyere according to the present invention will be explained, hereinafter.

In order to optimally keep the penetration depth formed at the front end of the oxygen tuyere according to the present invention, an optimal penetration depth according to the pressure in the melter gasifier under a constant amount of the oxygen injection, should be established. The optimal penetration depth can be obtained through data from experiments and experience.

In addition, the mutual relation between the changing amount of the pressure in the melter gasifier and the changing amount of the penetration depth should be obtained in the present invention. The mutual relation can be obtained through data from experiments and experience and also can be obtained by the following empirical equations as in the present invention. For the conventional blast furnace, the following empirical equation for the penetration depth formed at the front end of the oxygen tuyere, is suggested.

$$L_o(\text{penetration depth})=\text{diameter of tuyere}\times(1.3744\times10^{-2}\times RF+1.550) \quad (1)$$

$$RF(\text{raceway factor})=(\rho_{go}\cdot V_o^2/g\cdot S^2)\times(T_bP_o/T_oP)\times(1/d_{so}\cdot\rho_{so}) \quad (1a)$$

(Wherein, $V_o$: Volumetric flow rate of the oxygen

S: cross-sectional area of the tuyere $\rho_{go}$: gas density under a standard state P: pressure in the furnace $T_b$: Oxygen temperature $P_o$, $T_o$: pressure and temperature under a standard state (1atm, 273K)

$d_{so}$, $\rho_{so}$: diameter and density of charging coke.)

The penetration depth formed at the front end of the oxygen tuyere in the coal bed, has been presumed to use the above equation (1) in the method for producing the molten pig iron using the production apparatus of the molten pig iron utilizing the non-coking coal. Accordingly, the pressure in the furnace obtained by equation (1) is selected as an operating standard for keeping the optimal penetration depth.

However, equation (1) is the model equation which can be applied to the packed bed consisting of coke which has homogeneous particle size and density and is stable to the reaction. Therefore, the direct application of equation (1) to the compacting layer consisting of the non-coking coal of which structure is largely changed by he kind of the coal, the operating condition, etc. has a limitation.

That is, in the coal packed bed, the particle diameter and the density at the front end of the tuyere are subjected to the influence of the conditions of the raw material and the operation of such as the contained amount of the volatile material according to the kind of the coal, the degree of the heat efficiency of the coal according to the increasing velocity of the temperature and the pressure in the furnace, and the difference in the diameter decrease according to the reactivity for the gasification, etc.

Accordingly, the utilization of the model equation for the real operation is unreasonable.

A large change is formed in the distribution of the gas flow formed in the coal packed bed of melter-gasifier due to the change of the penetration depth in the melter gasifier, and this change affects the stability of the operation. Hence, the following model equation (2) which is obtained by improving equation (1) considering the above-mentioned factors which affect the optimal penetration depth, is used in the present invention. Through equation (2), the optimal penetration depth can be more rapidly obtained by obtaining the mutual relation of the changing amount of the pressure in the melter gasifier and the changing amount of the penetration depth under a constant amount of the oxygen blowing.

$$La(\text{penetration depth})=\text{diameter of tuyere}\times a\times RF+b \quad (2)$$

$$RF=(\rho_{go}\cdot V_o^2/g\cdot S^2)\times(T_bP_o/T_oP)\times(1/d_a\cdot\rho_a) \quad (2a)$$

Wherein a and b are constants, $d_a$ is the density of the coal corresponding to 60–85% of the density of the coal before the charging ($d_{so}$) and $\rho_a$ is the particle size of the coal corresponding to 30–70% of the particle size of the coal before the charging ($\rho_{so}$).

That is, $d_a=d_{so}\times(0.6–0.85)$ and $\rho_a=\rho_{so}\times(0.3–0.7)$.

Of course, the mutual relation between the changing amount of the pressure in the melter gasifier and the changing amount of the penetration depth under the constant amount of the oxygen blowing, can be obtained considering the conventional operating data and experimental data, in the present invention.

Next, the penetration depth is continuously measured by installing the sensor for measuring distance using a laser at one optional oxygen tuyere. The difference between the measured actual penetration depth and the optimal penetration depth is continuously obtained.

The changing amount of the pressure in melter gasifier 11 is obtained by the mutual relation of the changing amount of the pressure in melter gasifier 11 and the changing amount of the penetration depth using the difference between the measured actual penetration depth and the optimal penetration depth.

Next, the opening degree of the scrubber cone is controlled by thus obtained changing amount of the pressure to control the pressure in melter gasifier 11. Then, the blowing velocity of the oxygen into the oxygen tuyere can be controlled and therefore, the penetration depth can be controlled.

The optimal penetration depth formed at the front end of the oxygen tuyere, can be kept by repeating the above-described steps until the actual penetration depth and the optimal penetration depth are the same.

Figure 3:
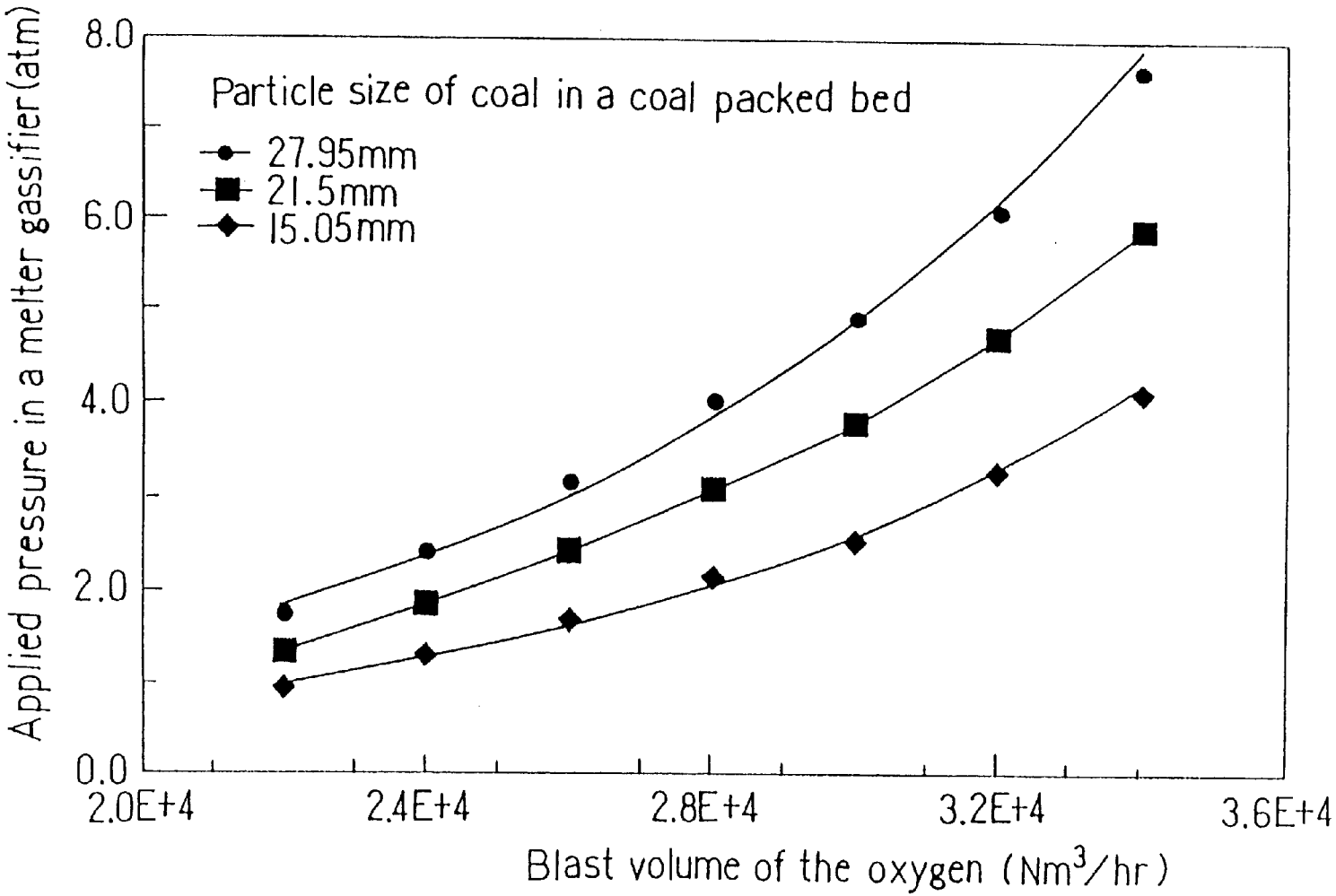
FIG. 3 is a graph for showing the relation between the change of the blast volume of the oxygen and applied pressure in a melter gasifier with respect to the change of the particle size of coal in a coal packed bed according to the present invention.

Meanwhile, FIG. 3 is a graph illustrating the mutual relation between the change of the blast volume of the oxygen blown through the oxygen tuyere with the pressure applied in the melter gasifier for keeping the optimal penetration depth (i.e. 0.6 m) formed at the front end of the oxygen tuyere, according to the particle sizes of the coal which forms the coal packed bed. As illustrated in FIG. 3, the applied pressure in the melter gasifier should be increased when the blast volume of the oxygen is increased to keep the optimal penetration depth. Further, the applied pressure in the melter gasifier also should be increased when the particle size of the coal, which forms the coal compacting layer, is smaller.

As described above, the control of the optimal penetration depth formed at the front end of the oxygen tuyere can actively cope with the change of the volumetric flow rate of the oxygen and the change of the consisting material of the coal packed bed according to the change of various conditions of raw material in the producing facilities of the molten pig iron utilizing the non-coking coal. Therefore, the utilizing efficiency of the coal combustion energy which is the main energy supplying source for the producing facilities of the molten pig iron utilizing the non-coking coal, can be maximized.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. An apparatus for keeping an optimal penetration depth formed at a front end of an oxygen tuyere including a melter gasifier for producing molten pig iron, a plurality of oxygen tuyeres formed around the outer lower portion of said melter gasifier for blowing oxygen into said melter gasifier, a cyclone for receiving an exhausted gas from said melter gasifier and for separating powder from said exhausted gas, a pre-reducing furnace for receiving said exhausted gas passed through said cyclone and for pre-reducing iron ores and a scrubber having a cone for controlling pressure in said melter gasifier, said apparatus comprising:

a sensor means including a laser for measuring distance installed at one of said oxygen tuyeres for continuously measuring said penetration depth;

a process computer for continuously receiving said measured penetration depth from said sensor means and for comparing said received penetration depth with a predetermined optimal penetration depth to obtain a difference between said actual penetration depth and said optimal penetration depth, and for obtaining a changing amount of a pressure in said melter gasifier through a mutual relation between a predetermined changing amount of a pressure in said melter gasifier and a changing amount of said penetration depth using said difference between said actual penetration depth and said optimal penetration depth; and a scrubber cone controlling device for receiving said changing amount of said pressure in said melter gasifier from said process computer and for changing an opening degree of a scrubber cone to change said pressure in said melter gasifier.

2. An apparatus for keeping an optimal penetration depth formed at a front end of an oxygen tuyere as claimed in claim 1, wherein a high tension steel casing is provided at an outer portion of said sensor for measuring distance using a laser and a constant crevice is formed at a front end of said casing.

3. An apparatus for keeping an optimal penetration depth formed at a front end of an oxygen tuyere as claimed in claim 2, wherein a fused silica having a constant thickness is inserted into said crevice formed at said front end of said casing.

4. An apparatus for keeping an optimal penetration depth formed at a front end of an oxygen tuyere as claimed in claim 1, wherein a fused silica plate having a constant thickness is inserted into a crevice formed at a front end of a high tension steel casing.

5. A method for keeping an optimal penetration depth formed at a front end of an oxygen tuyere in a method for producing molten pig iron utilizing a producing apparatus of said molten pig iron utilizing non-coking coal, said apparatus including a melter gasifier for producing molten pig iron, a plurality of oxygen tuyeres formed around an outer lower portion of said melter gasifier for blowing oxygen into said melter gasifier, a cyclone for receiving an exhausted gas from said melter gasifier and for separating powder from said exhausted gas, a pre-reducing furnace for receiving said exhausted gas passed through said cyclone and for pre-reducing iron ores and a scrubber having a cone for controlling pressure in said melter gasifier, said method comprising the steps of:

(a) establishing said optimal penetration depth according to a pressure in said melter gasifier under a constant amount of oxygen blowing;

(b) obtaining a mutual relation between a changing amount of a pressure in said melter gasifier under a constant amount of oxygen blowing and a changing amount of said penetration depth;

(c) continuously measuring said penetration depth by a sensor for measuring distance using a laser installed at one of said oxygen tuyeres;

(d) continuously obtaining a difference between said measured actual penetration depth and said optimal penetration depth;

(e) obtaining a changing amount of said pressure in said melter gasifier by said mutual relation between said changing amount of said pressure in said melter gasifier and said changing amount of said penetration depth utilizing said difference between said measured actual penetration depth and said optimal penetration depth;

(f) controlling said pressure in said melter gasifier as much as said changing amount of said obtained pressure by controlling an opening degree of said scrubber cone; and (g) repeating steps (d), (e) and (f) until said actual penetration depth and said optimal penetration depth become the same.

6. A method for keeping an optimal penetration depth formed at a front end of an oxygen tuyere as claimed in claim 5, wherein said mutual relation between said changing amount of said pressure in said melter gasifier and said changing amount of said penetration depth under a constant amount of oxygen blowing is obtained by the following equations:

$$\text{La (penetration depth)} = \text{diameter of tuyere} \times a \times RF + b \qquad \text{Eq.2}$$

and $$RF\ (\text{raceway factor}) = (\rho_{go} \cdot V_o^2 / g \cdot S^2) \times (T_b P_o / T_o P) \times (1/d_a \cdot \rho_a) \qquad \text{Eq.2(a)}$$

wherein:

a and b are constants, $\rho_{go}$ is gas density under a standard state, $V_o$ is volumetric flow rate of the oxygen, g represents gravity constant, S is a cross-sectional area of the tuyere, $T_b$ is oxygen temperature, $P_o$, $T_o$ are pressure and temperature under a standard state (1 atm, 273K), P is pressure in the furnace, $d_a$ is a density of coal corresponding to 60–85% of a density of coal before charging ($d_{so}$), and $\rho_a$ is a particle size of coal corresponding to 30–70% of a particle size of coal before charging ($\rho_{so}$).

* * * * *

UNITED STATES PATENT AND TRADEMARK OFFICE

CERTIFICATE OF CORRECTION

PATENT NO. : 6,228,142 B1
DATED : May 8, 2001
INVENTOR(S) : Myoung Kyun Shin et al.

It is certified that error appears in the above-identified patent and that said Letters Patent is hereby corrected as shown below:

Title page,
Item [73], Assignees: "(AU)" should read -- (AT) --.

Column 1,
Line 25, "characteristic" should read -- characteristics --.
Line 36, "have accelerate" should read -- have accelerated --.
Line 37, "method" should read -- methods --.
Line 55, "noncoking" should rad -- non-coking --.

Column 3,
Line 36, "noncoking" should read -- non-coking --.

Column 5,
Line 31, "by he" should read -- by the --.

Signed and Sealed this

Eleventh Day of June, 2002

*Attest:*

*Attesting Officer*

JAMES E. ROGAN
*Director of the United States Patent and Trademark Office*